US005425577A

United States Patent [19]

Gembler

[11] Patent Number: 5,425,577

[45] Date of Patent: Jun. 20, 1995

[54] STORAGE FILE WITH AUTO-RETRACTING DOOR

[76] Inventor: Jeffrey L. Gembler, 3200 Lochness Dr. #7, Lexington, Ky. 40517

[21] Appl. No.: 115,919

[22] Filed: Sep. 1, 1993

[51] Int. Cl.[6] ..... A47B 81/00

[52] U.S. Cl. ..... 312/273; 74/110; 312/319.2; 312/271

[58] Field of Search ..... 312/273, 271, 272, 272.5, 312/110, 322, 319.2; 74/110

[56] References Cited

U.S. PATENT DOCUMENTS

| | | | |
|---|---|---|---|
| 552,441 | 12/1895 | Mathews . | |
| 715,243 | 12/1902 | Casler | 312/110 |
| 726,957 | 5/1903 | Macey | 312/110 X |
| 2,569,209 | 9/1951 | Welk | 312/271 |
| 2,814,545 | 11/1957 | Cornish | 312/271 |
| 2,826,473 | 3/1958 | Hischle . | |
| 2,836,477 | 5/1958 | Karoff | 312/273 X |
| 2,872,267 | 2/1959 | Machingo et al. | 312/273 |
| 3,323,853 | 6/1967 | Stark | 312/110 X |
| 3,339,995 | 9/1967 | Bencene | 312/322 |
| 3,378,324 | 4/1968 | Earle | 312/322 X |
| 3,650,590 | 3/1972 | Frederick et al. | 312/273 X |
| 3,794,401 | 2/1974 | Dean et al. | 312/110 X |
| 3,883,205 | 5/1975 | Ambaum et al. . | |
| 4,389,078 | 6/1983 | Streit | 312/322 |

FOREIGN PATENT DOCUMENTS

| | | | |
|---|---|---|---|
| 836562 | 4/1952 | Germany | 312/273 |
| 611855 | 11/1948 | United Kingdom | 312/273 |

*Primary Examiner*—Kenneth J. Dorner
*Assistant Examiner*—Janet M. Wilkens
*Attorney, Agent, or Firm*—King and Schickli

[57] ABSTRACT

A storage file includes a cabinet enclosure with five closed and one open side. A tray is received in the cabinet enclosure. The tray is selectively moveable by sliding between fully opened and fully closed positions. A retractable door is mounted to the cabinet enclosure. A spring loaded linkage connects the retractable door to the tray. When the tray is opened, the door retracts, by operation of the linkage, into the cabinet enclosure exposing the tray and its contents. When the tray is closed, the door is closed by operation of the linkage thereby sealing the contents in the tray within the cabinet enclosure.

16 Claims, 6 Drawing Sheets

STORAGE FILE WITH AUTO-RETRACTING DOOR

TECHNICAL FIELD

The present invention relates generally to storage files and, more particularly to a storage file including an automatically retractable cover or door.

SUMMARY OF THE INVENTION

It has long been known to provide storage files that may be utilized to organize objects and retain them out of view in an enclosure where they are protected from observation, light and dirt. Such storage files may, for example, be utilized to store and organize audio cassettes, video cassettes, computer disks and note cards among other objects.

Two storage files of the type described are disclosed in U.S. Pat. Nos. 3,883,205 to Ambaum et al and 3,323,853 to Stark. In Ambaum, a five sided enclosure receives a sliding drawer. A pivotal cover seals the sixth side of the cabinet when the drawer is closed. A projecting cam arm on the drawer pivots the cover open as the drawer is pulled from the enclosure.

In Stark, a five sided enclosure or cabinet is also provided including a sliding drawer. A retractable cover seals the sixth side when the drawer is closed. The retractable cover is manually operated and must first be opened before the drawer may be pulled from the enclosure.

While both of the storage cabinets described in these patents are effective for their intended purpose, they certainly may be improved to provide more convenient function. Specifically, the pivoting, "overhead" door in Ambaum does not retract and obstructs vision into the drawer as the drawer is withdrawn from the enclosure. In contrast, in Stark, convenient accessibility to the drawer is prevented as a result of a need to manually retract the cover prior to drawer operation being made possible. Thus, a need is clearly identified for an improved storage file that provides a cover or door that automatically retracts as the drawer is pulled from the cabinet.

SUMMARY OF THE INVENTION

Accordingly, it is a primary object of the present invention to provide a storage file including an automatically retracting cover or door of relatively simple, inexpensive design that provides reliable, trouble-free and convenient operation as well as improved visibility of drawer contents when the drawer is opened.

Another object of the invention is to provide a storage file for protecting stored objects from observation, light and dirt when stored but also allowing ready access by simply pulling a drawer open.

Another object of the invention is to provide a storage file including a rack and pinion mechanism for operation of an automatically retracting door or cover particularly adapted to provide smooth, consistent and dependable operation of the cover.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved storage file is provided for holding various objects including, for example, audio cassettes, video cassettes, computer disks and note cards. The storage file includes a cabinet enclosure having five closed sides and one open side. A tray or drawer for holding objects is received in the open side of the cabinet enclosure. Specifically, the tray is provided in sliding engagement with the cabinet enclosure and selectively moveable between a fully closed position wherein the tray is fully received within the cabinet enclosure and a fully opened position wherein the tray is fully extended from the cabinet enclosure to allow access to the objects. Preferably, the tray includes a bottom wall, a pair of opposed sidewalls, a rear end wall and a front end wall forming a cavity for holding the objects.

Additionally, a door is mounted on the cabinet enclosure. This door is biased by operation of a spring loaded linkage that follows the movement of the tray so that moving of the tray from the closed to the opened position swings the door open and moving of the tray from the opened to the closed position swings the door closed. Together, the door and front end wall of the tray form the sixth and final side of the cabinet enclosure that seals the tray contents from observation, light and dust.

More specifically, the spring loaded linkage includes a drive rack mounted to the cabinet enclosure for relative sliding movement thereto and a biasing spring. The biasing spring is fixed at one end to the cabinet enclosure and at the opposite end to the drive rack. An L-shaped bracket, fixed to the drive rack, includes a projecting leg for engaging the tray under the biasing force of the spring. Accordingly, it should be appreciated that the movement of the drive rack under the force of the biasing spring follows the movement of the tray.

This drive rack further includes opposed racks for driving two pinions mounted on the cabinet enclosure so as to provide relative rotation. Additionally, the door includes a pair of driven racks connected to the door that mesh with the pinions. Channels are provided in the cabinet enclosure to guide the driven racks as they slide relative to the cabinet enclosure when the door is retracted into the opened position within the cabinet enclosure during tray opening or is moved into the closed position during tray closing.

Advantageously, the present spring loaded linkage system allows convenient operation of the file cabinet. More specifically, by simply opening the tray, the door is smoothly and quickly retracted into the cabinet enclosure to allow full, unobstructed viewing of the tray contents. Alternatively, the door is automatically closed to seal the open side of the cabinet enclosure when the tray is closed. Further, the rack and pinion drive arrangement provides the necessary engagement at each lateral side of the storage file to ensure that the door operates in a straight line and will not wedge in the cabinet enclosure during movement. Accordingly, smooth door operation is also advantageously ensured.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Figures 1A, 1B:
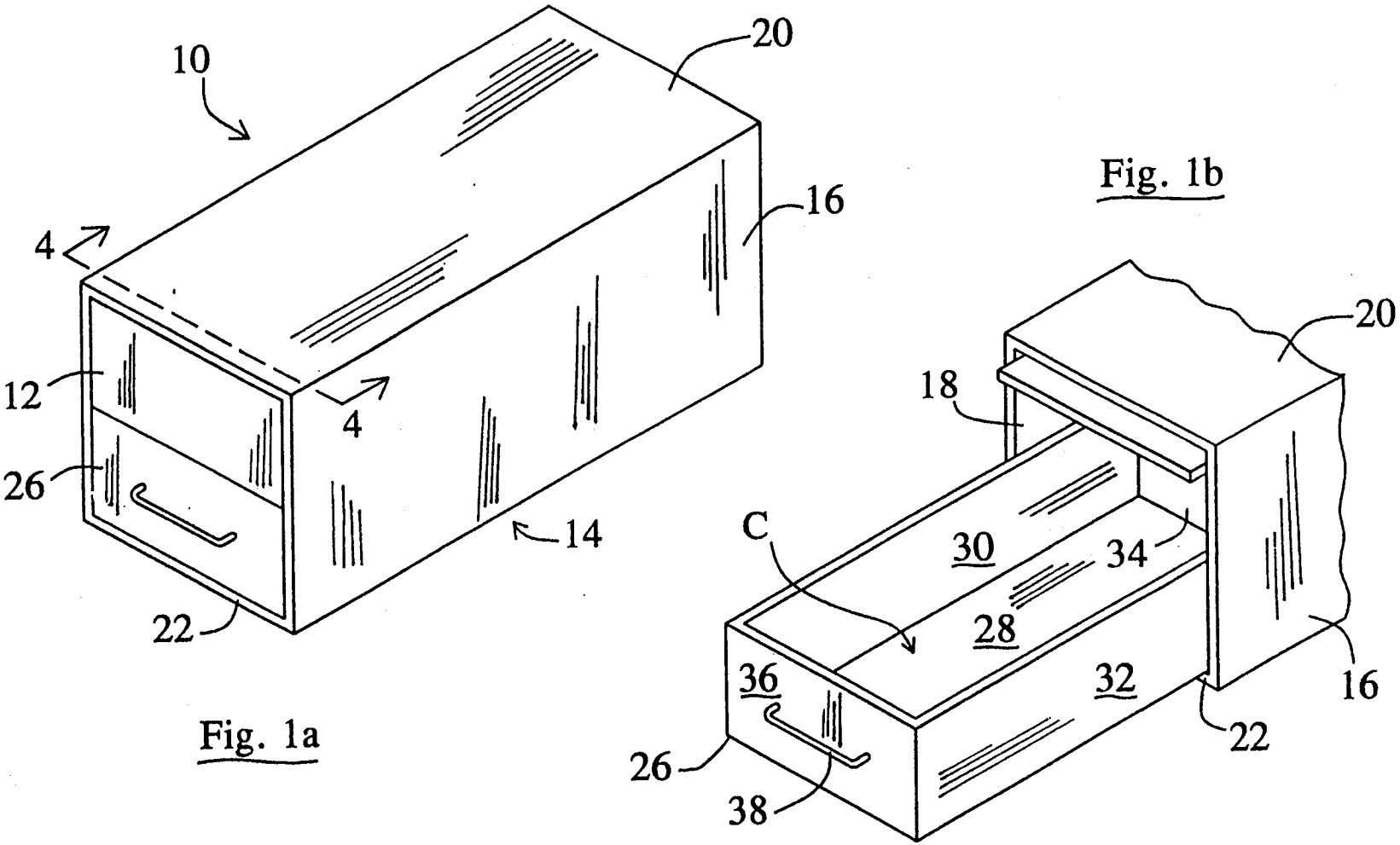
FIG. 1*a* is a perspective view of the storage file i in the closed position.
FIG. 1*b* is a fragmentary/perspective view of the storage file in the opened position.

Reference will now be made in detail to the present preferred embodiment of the invention.

DETAILED DESCRIPTION OF THE DRAWING

Reference is now made to the drawing FIGS. showing the improved storage file 10 of the present invention including an auto-retracting door 12, the structure and operation of which will be described in greater detail below. As the description hereof proceeds, it should be appreciated that the storage file 10 provides a number of operational and convenience advantages not available in storage files of prior art design.

As best shown in Figure la, the storage file 10 includes a cabinet enclosure, generally designated by reference numeral 14. The cabinet enclosure 14 is five-sided including a pair of opposed sidewalls 16, 18, an interior transverse wall 19, a top wall 20, a bottom wall 22, and rear end wall 24. The front end of the cabinet enclosure is open so as to receive a tray or drawer 26. As shown, the tray 26 is supported between the sidewalls 16, 18 by the bottom wall 22. A slight clearance is provided between the tray 26 and the sidewalls 16, 18 so that the tray is slidable and therefor moveable relative to the cabinet enclosure 14. Thus, it should be appreciated that the tray 26 may be selectively displaced between a fully closed position wherein the tray is fully received within the cabinet enclosure 14 and a fully opened position wherein the tray is fully extended from the cabinet enclosure to allow access to objects held therein.

More specifically, the tray 26 includes a bottom wall 28, a pair of opposed sidewalls 30, 32, a rear end wall 34 and a front end wall 36. Together these walls form a cavity C for holding objects such as audio cassettes, video cassettes, compact discs, computer disks or note cards.

When the tray 26 is fully closed, it should be appreciated that the door 12 and front end wall 36 of the tray come together to form the sixth and final wall of the cabinet enclosure 14 (see FIG. 1*a*). Thus, when the tray 26 is fully closed, the contents of the tray are effectively sealed within the enclosure preventing their observation and exposure to light and dirt.

Figure 2:
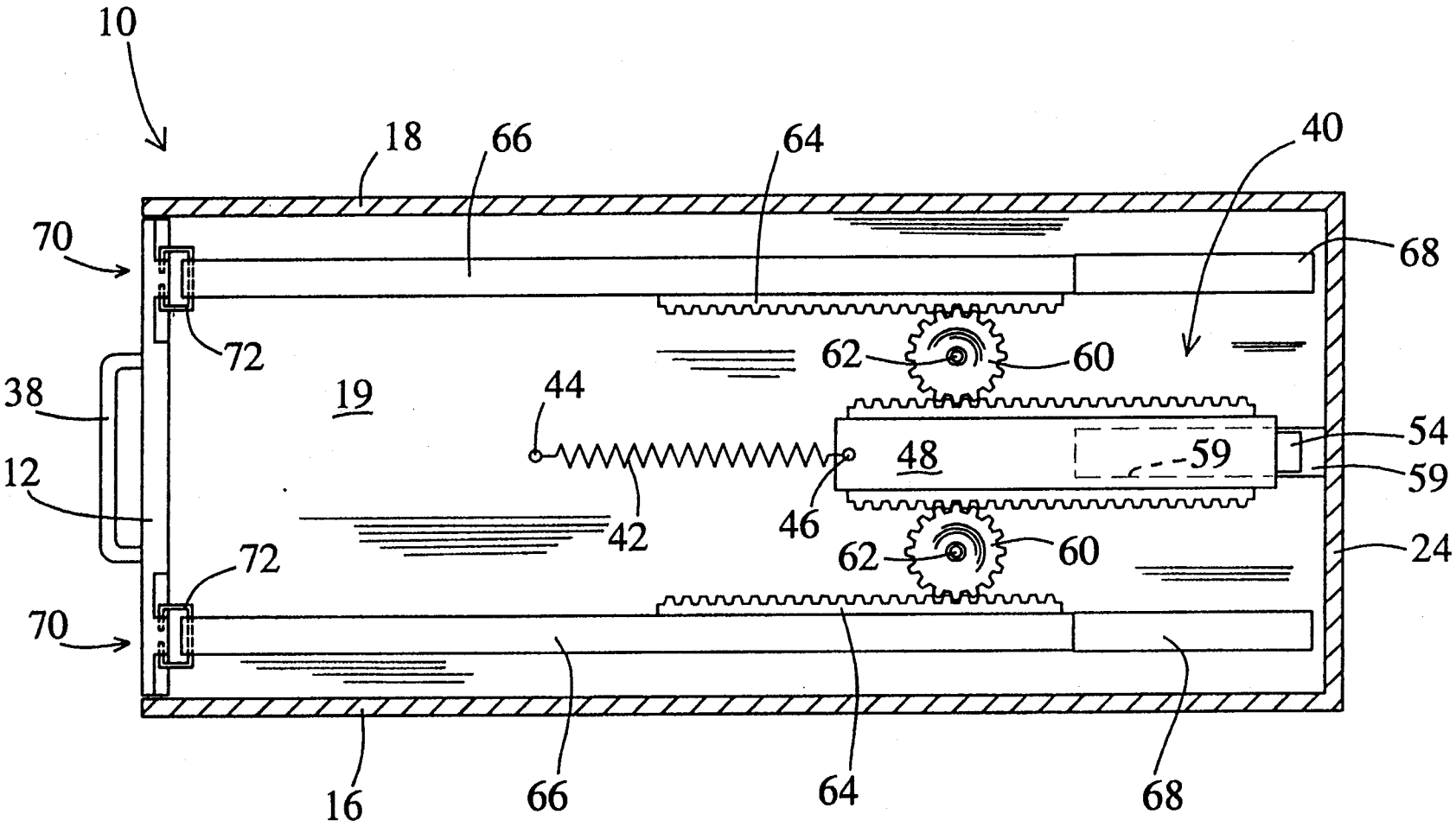
FIG. 2 is a top plan view with the upper wall of the cabinet enclosure removed to show the door linkage.

When the tray 26 is open by the means of handle 38 mounted to the front end wall 36, the door 12 automatically pivots and retracts into the cabinet enclosure 14. This action allows convenient one hand operation and a fully unobstructed view into the tray 26. The automatic operation of the door 12 is provided by operation of a spring loaded linkage, generally designated by reference numeral 40 that connects the door to the tray 26 (see FIGS. 2–4).

More specifically, the linkage 40 includes a helical tension spring 42 having a first end fixed by means of a pin 44 to the interior transverse wall 19 and a second end fixed by means of pin 46 to a dual, opposed drive rack 48. The drive rack 48 is received in a guideway cavity 50 in the interior transverse wall 19 so as to allow relative sliding movement to the cabinet enclosure 14. An overlying guide bar 52 insures that the drive rack 48 remains in the guideway cavity 50 during movement thereby providing smooth, trouble free operation.

Figure 3A:
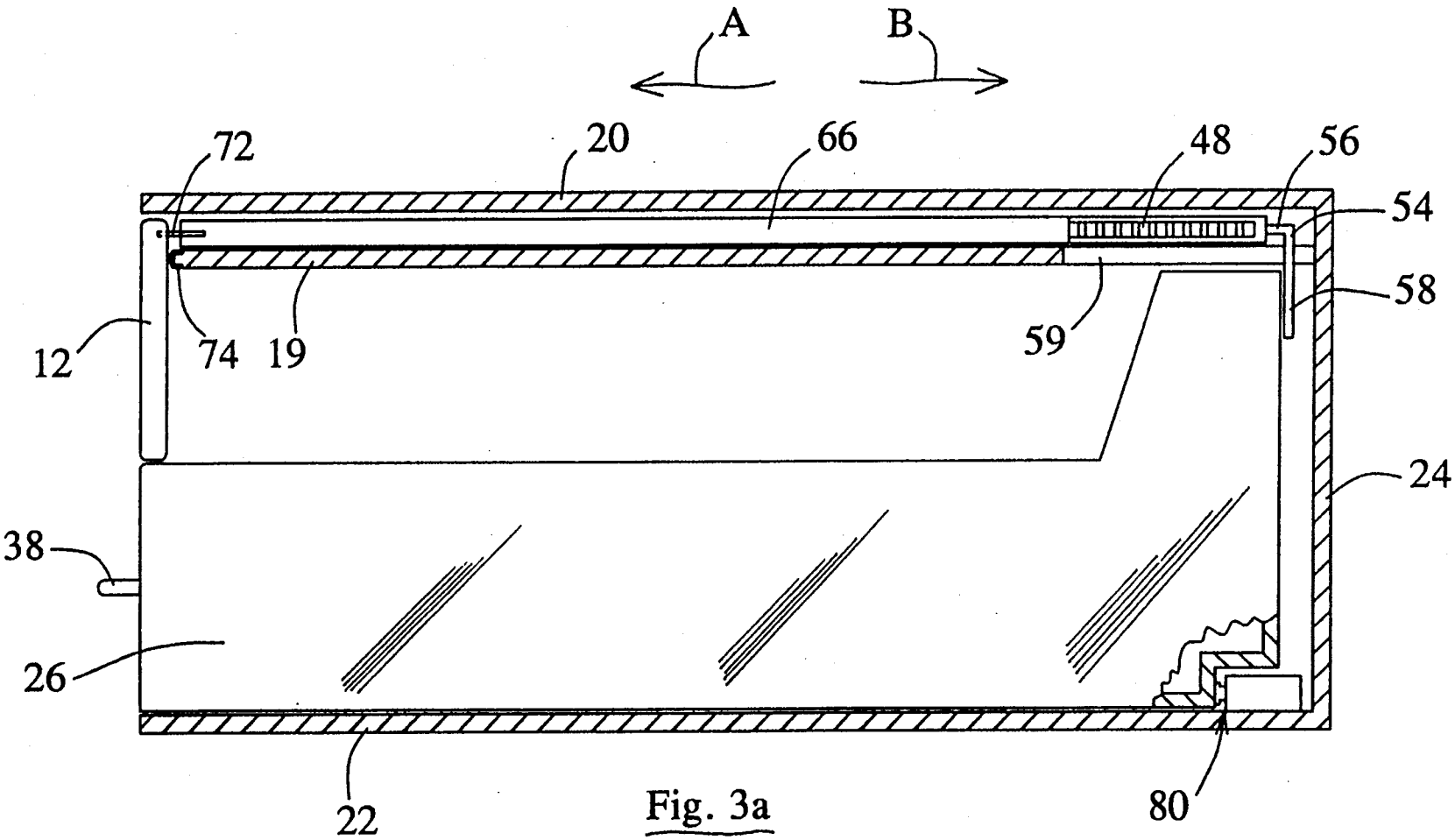
FIG. 3*a* is a partially sectional side view showing the door linkage and tray in the fully closed position.
Figure 3B:
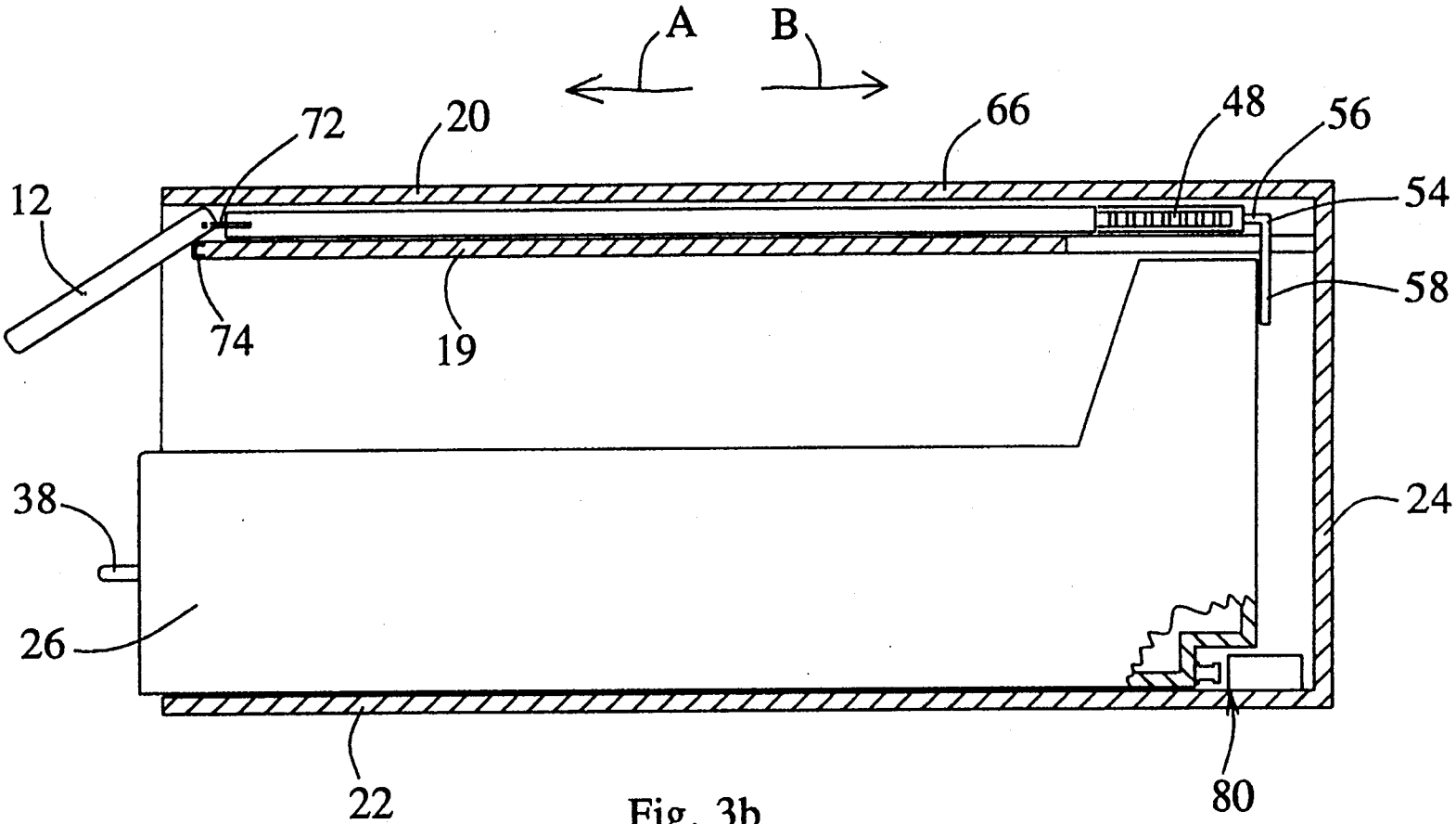
FIG. 3*b* is a view similar to FIG. 3*a* showing the tray in a partially opened, intermediate position.
Figure 3C:
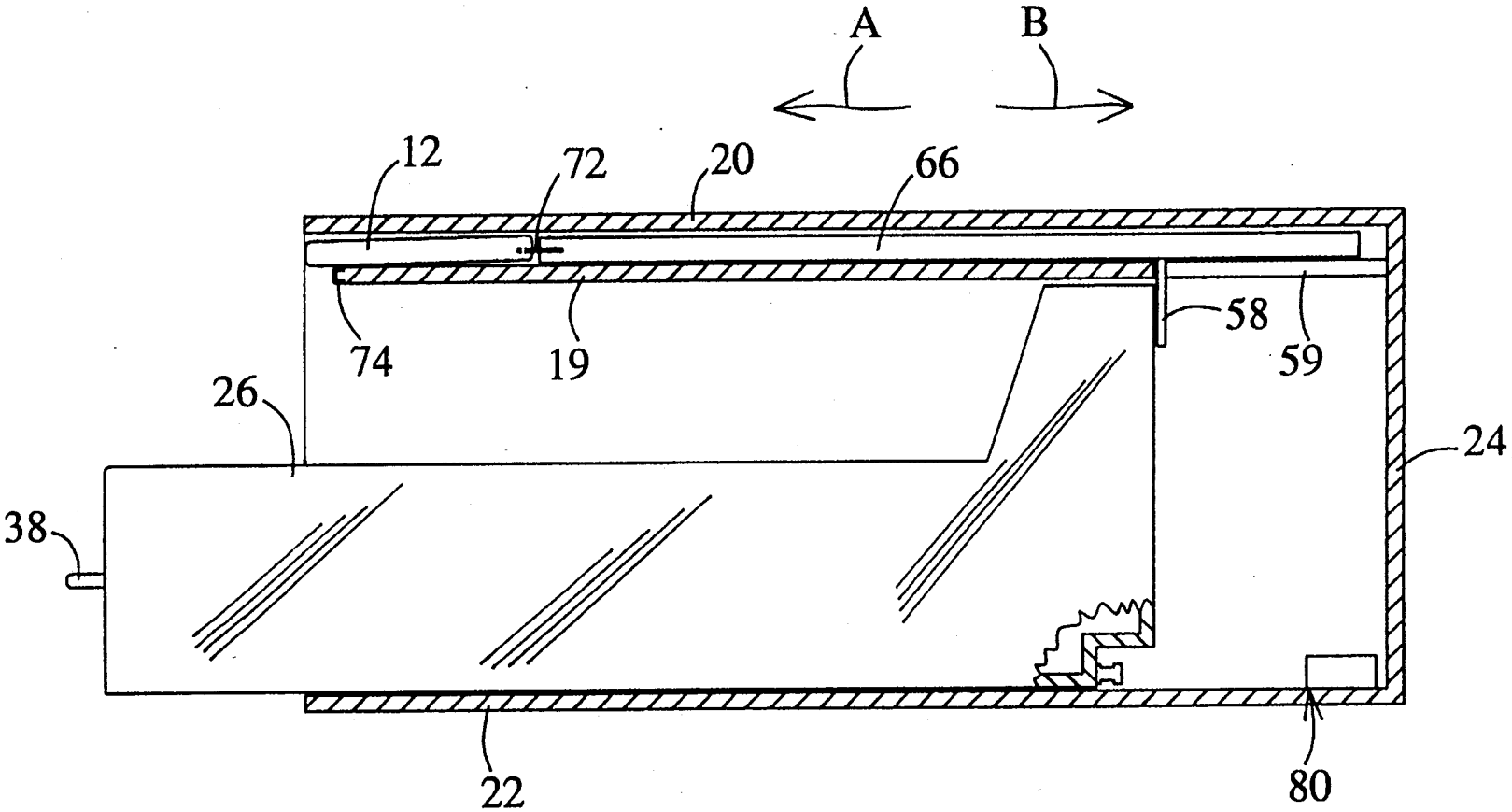
FIG. 3*c* is a view similar to FIGS. 3*a* & 3*b* showing the tray in the fully opened position.
Figure 4:
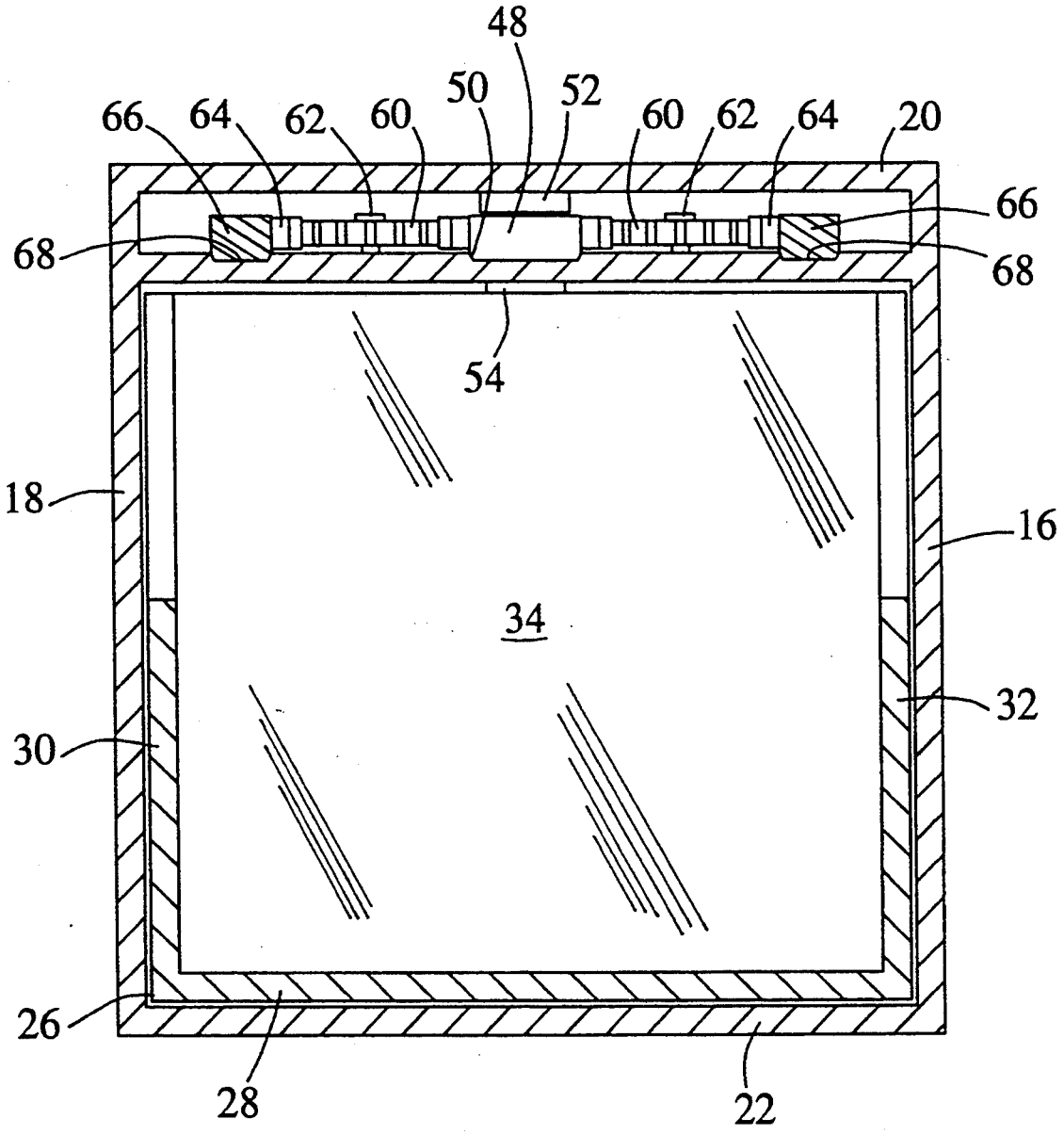
FIG. 4 is a cross-sectional view along line 4—4 of FIG. 1*a*.

The drive rack 48 is operatively connected to the tray 26 by means of an L-shaped bracket 54. As best shown in FIGS. 3*a*–3*c*, a first leg 56 of bracket 54 is fixed to the drive rack 48. A second leg 58 projects through an opening 59 in the interior transverse wall 19 so as to engage the rear end wall 34 of the tray 26. As will be more fully appreciated from the description that follows, the leg 58 is not connected or fastened to the rear end wall 34 of tray 26 but instead only follows the movement of the tray under the biasing force of the compression spring 42. Thus, the tray 26 is fully removeable from the cabinet enclosure 14 if desired.

The drive rack 48 is also operatively connected to the door 12. More specifically, two pinions 60 are rotatably mounted on stub shafts 62 to the interior transverse wall 19, This mounting allow rotation of the pinions 60 relative to the cabinet enclosure 14. As shown best in FIGS. 2 and 4, each of the pinions 60 is mounted to operatively engage one of the opposed racks of the drive rack 48.

The linkage 40 also includes a pair of driven racks 64. Each driven rack 64 includes an elongated guide block 66 adapted to engage a cooperating channel 68 formed in the interior transverse wall 19 of the cabinet enclosure 14. As shown, one driven rack 64 is positioned adjacent each side wall 16, 18. As should be further appreciated, each driven rack 64 engages one of the pinions 60 while the guide blocks 66 and channels 68 cooperate to allow the driven racks 64 to slide relative to the cabinet enclosure 14.

As also shown in FIGS. 2 and 3*a*–3*c* the driven racks 64 are connected to the door 12 by means of a pair of trunnions 70 including C-shaped pins 72. Advantageously, such an arrangement allows the door 12 to pivot into the enclosure 14 during opening and closing while also providing translational motion for purposes of retraction.

The operation of the linkage 40 and the door 12 will now be described in detail. Starting from the fully closed position (see FIG. 3*a*), as the tray 26 is opened, the dual drive rack 48 moves under the force of spring 42 longitudinally in the direction of action arrow A as far as the engagement of the projecting leg 58 with the rear tray wall 34 allows. The meshing of the dual rack 48 with the pinions 60 causes the pinions to rotate. The meshing of the pinions 60 with the driven racks 64 causes the driven racks to slide relative to the interior transverse wall 19 and cabinet enclosure 14 in the direction of action arrow B. Through connection of the driven racks 64 to the door 12 by means of the trunnions 70 the door 12 is pivoted open and simultaneously retracted into the cabinet enclosure 14. Cam guides 74, mounted to the sidewalls 16, 18 function to guide the door 12 as it is pivoted and retracted. Preferably, these cam guides 74 are of substantially rounded contour although arched guide surfaces could also be provided.

The gearing between the dual drive rack, pinions and driven racks 48, 60, and 64 respectively, is carefully selected to ensure that the door 12 is rapidly opened as the tray 26 is withdrawn. In this way clearance is rapidly provided to allow the passage of taller objects held in the tray 26. Further, the two driven racks 64 serve to support the door 12 adjacent each side and ensure smooth, even operation. In fact, the resulting dual side engagement virtually insures that the door 12 does not become crooked during operation and wedged in the cabinet enclosure 14.

As the tray 26 is closed, the rear end wall 34 through engagement with the projecting leg 58 causes the drive rack 48 to be displaced against the force of the spring 42 rearwardly in the direction of action arrow B. Accordingly, the pinions 60 and driven racks 64 are all driven in opposite directions to that when opened. This causes the door 12 to pivot closed so that the door and front end wall 36 of the tray 26 meet in edge to edge engagement and effectively provide a fully sealed cabinet enclosure 14. A touch latch 80 of a type known in the art engages when the tray 26 is fully closed to positively lock the tray in the closed position against the force of the spring 42. This latch 80 may be released by first pushing inwardly on and then quickly releasing the tray 26. The tray 26 and the door 12 are then drawn open by the biasing force of the spring 42. As previously described.

In summary, numerous benefits result from employing the concepts of the present invention. Advantageously, a storage file 10 of relatively simple and inexpensive construction includes an automatically retracting door 12 that cooperates with the front end wall 36 of the tray 26 to seal the cabinet enclosure 14 when the tray is closed. By simply pulling the tray 26 open, the door 12 pivots and retracts into the cabinet enclosure 14 to allow clearance for objects in the tray and an unobstructed view of those objects as the tray is opened. The rack and gear linkage 40 advantageously provides smooth and trouble free operation and also aides in preventing the tray from becoming wedged in the cabinet enclosure during opening and closing.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with breadth to which they are fairly, legally and equitably entitled.

I claim:

1. A storage file device for audio cassettes, video cassettes, computer discs, note cards and other objects, comprising:

a cabinet enclosure; including one opening;

a tray for holding objects received in sliding engagement in said cabinet enclosure, said tray being selectively moveable between a fully closed position wherein said tray is fully received within said cabinet enclosure and a fully opened position wherein said tray is fully extended from said cabinet enclosure to allow access to said objects;

a door mounted on said cabinet enclosure; a front end wall of said tray and said door cooperating to close said opening when said tray and door are in said closed position; and means for operatively linking said door to said tray whereby moving of said tray from said closed to said opened position swings said door open and moving of said tray from said opened to said closed position swings said door closed.

2. The device as set forth in claim 1, wherein said cabinet enclosure includes five closed sides.

3. The device as set forth in claim 1, wherein said tray includes a bottom wall, a pair of opposed side walls, a rear end wall and said front end wall forming a cavity for holding said objects.

4. The device as set forth in claim 3, wherein said front end of said tray includes handle means for grasping so as to allow opening and closing of said tray.

5. The device as set forth in claim 3, wherein said linkage means includes a drive rack mounted to said cabinet enclosure for relative sliding movement, means for biasing said drive rack and said door into an open position and means for operatively engaging said tray.

6. The device as set forth in claim 5, wherein said linkage means further includes pinion means mounted to said cabinet so as to allow relative rotation, said pinion means meshing with said drive rack and being driven thereby as said tray is opened and closed.

7. The device as set forth in claim 6, wherein said door is retractable and a driven rack is mounted to said door, said driven rack meshing with said pinion means.

8. The device as set forth in claim 7, wherein said cabinet enclosure includes a channel for guiding said driven rack as said driven rack slides relative to said cabinet enclosure when driven by said pinion means.

9. The device as set forth in claim 8, including flexible coupling means connecting said driven rack to said door.

10. The device as set forth in claim 6, wherein said drive rack is a dual drive rack with opposed rack for driving two pinions rotatably mounted to said cabinet enclosure.

11. The device as set forth in claim 10, wherein said door is retractable and a pair of driven racks are mounted to said door, each of said driven racks meshing with one of said pinions.

12. The device as set forth in claim 11, wherein said cabinet enclosure includes channels for guiding said driven racks as they slide relative to said cabinet enclosure when driven by said pinions.

13. The device as set forth in claim 12, including flexible coupling means connecting each of said driven racks to said door.

14. The device as set forth in claim 13, wherein cam guides are mounted to said cabinet enclosure, said cam guides engaging and guiding said door as said door pivots and retracts.

15. The device as set forth in claim 5, wherein said biasing means is a spring operatively connected at a first end to said cabinet enclosure and at a second end to said drive rack.

16. The device as set forth in claim 5, wherein said tray engaging means is an L-shaped stop fixed to said drive rack and having a projecting leg for engaging said tray under the force of said biasing means.

* * * * *